United States Patent [19]

Pickering

[11] 4,205,653

[45] Jun. 3, 1980

[54] DOWNFLOW FURNACE ASSEMBLY

[75] Inventor: Mark A. Pickering, Lebanon, Ind.

[73] Assignee: Carrier Corporation, Syracuse, N.Y.

[21] Appl. No.: 869,088

[22] Filed: Jan. 13, 1978

[51] Int. Cl.[2] ..... F24H 3/00

[52] U.S. Cl. ..... 126/114; 126/116 B; 126/110 AA; 62/262

[58] Field of Search ..... 126/110 AA, 110 R, 110 A, 126/110 B, 110 C, 110 D, 110 E, 114, 116 B, 116 A, 116 C; 122/494; 62/262

[56] References Cited

U.S. PATENT DOCUMENTS

| | | | |
|---|---|---|---|
| 3,094,916 | 6/1963 | McGrath et al. | 62/262 |
| 3,283,753 | 11/1966 | Bodett et al. | 126/110 AA |
| 3,614,949 | 10/1971 | Goodgion | 126/110 AA |
| 3,871,039 | 3/1975 | Garceau et al. | 5/181 |

*Primary Examiner*—Samuel Scott
*Assistant Examiner*—Wesley S. Ratliff, Jr.
*Attorney, Agent, or Firm*—Donald F. Daley; John S. Sensny

[57] ABSTRACT

A downflow furnace assembly having a combustible floor base including a pair of parallel side rails, a pair of parallel, variable length cross rails, and integral spacing flanges, and a method of constructing the combustible floor base. The integral spacing flanges are for maintaining the lower plenum of the downflow furnace assembly at a preset distance from the edge of a combustible floor and are formed by die pressing the same metal sheets that are pressed to form the rails of the floor base. The variable length cross rails are each comprised of a pair of interfitted channel members that are in slidable communication with each other. By sliding the channel members with respect to each other, the lengths of the cross rails and the width of the base can be adjusted. The surface of each channel member defines a plurality of holes, and each cross rail can be adjusted to various preset lengths by aligning different holes. In a preferred embodiment, the cross rails include joiner members which allow the cross rails to be easily secured to the side rails at a plurality of positions so that the depth of the floor base can also be varied.

6 Claims, 6 Drawing Figures

DOWNFLOW FURNACE ASSEMBLY

BACKGROUND OF THE INVENTION

This invention relates to downflow furnace assemblies, and more particularly to the combustible floor base of such an assembly and a method of constructing combustible floor bases.

Downflow furnace assemblies are frequently used to heat homes and other buildings. Such an assembly may comprise, generally, a return air plenum located at the top of the assembly for receiving air from the rooms of the building, a fan to cause the air to flow downward through the assembly, a furnace positioned below the return air plenum where the air can be heated by, as examples, electric resistance heat or a gas fueled burner, and a lower plenum positioned below the furnace for receiving the relatively warm air from the furnace and directing the air toward a plurality of room air ducts which guide the heated air to the individual rooms of building. In addition, in many instances the assembly will include the evaporator coil of an air conditioning unit. The evaporator coil, which can be used to cool air flowing through the assembly, is usually placed in an evaporator coil casing which is positioned above the lower plenum and below the furnace. Use of an evaporator coil in this manner permits both central heating and central air conditioning of the building with only one network of air ducts.

Normally, the room air ducts are located in the space underneath the floor of the building, the furnace is located above the floor, and the lower plenum extends through the floor to connect the furnace with the room air ducts. In many buildings the floor is constructed of combustible material such as wood. When the lower plenum of a downflow furnace assembly extends through such a floor, it is desirable to eliminate the transfer of heat from the assembly, and especially the lower plenum, to the floor. Typically, this is done by the use of a combustible floor base.

Commonly, a combustible floor base includes a pair of side rails and a pair of cross rails. Usually, the rails are fashioned by die pressing metal sheets. Then the ends of the rails are spot welded together to form a generally rectangular base. The rails are shaped so that the floor base can be used with suitable insulating material to provide a thermally insulating frame for the lower plenum for preventing the transfer of heat from the lower plenum to the floor. After the rails are shaped, separate pieces of metal are spot welded to the rails perpendicular thereto, forming spacing tabs or flanges. These flanges cooperate with the edge of the floor to maintain a predetermined distance between the lower plenum and the floor, further insulating the floor from the plenum.

As may be expected, a variety of sizes of downflow furnace assemblies are available, In particular, furnaces and evaporator coil casings come in a wide range of widths and depths, with the size of the lower plenum of the assembly usually matched to fit either the furnace or the evaporator coil casing. Heretofore, different types of floor bases were constructed for each size assembly. That is, combustible floor bases have not been designed or manufactured so that a single base might be used with a number of different sizes of downflow furnace assemblies. This has several disadvantages. First, the multiplicity of types of floor bases increases the complexity of the manufacture of floor bases by increasing the number of different parts involved in the manufacturing process. Second, the fact that different floor bases are designed for different assemblies requires, naturally, that, when a downflow furnace assembly is installed, the specific floor base that is adapted for use with that assembly must be available. Frequently, this is not the case, resulting in a waste of time in obtaining the correct type of floor base.

Bases or frames that may be adjusted to a variety of sizes are, of course, well known. For example, adjustable bed frames are described in U.S. Pat. Nos. 3,775,783; 3,781,930; and 3,871,039. These patents appear to be the most relevant prior art due to the fact that they disclose frames which may be adjusted to a number of different widths. As discussed below, this feature is incorporated into the present invention. The present invention, though, uses adjustable bases in a downflow furnace assembly, and this use of adjustable bases is not disclosed or suggested by the above-mentioned patents. In addition, the adjustable base of the present invention includes integral spacing flanges which cooperate with the edge of a floor to keep the lower plenum of a downflow furnace assembly at a preset distance from the floor. The frames shown in the above-named patents do not have such flanges, and this also distinguishes the present invention from the disclosures of these patents. Moreover, in a preferred embodiment, the floor base of the present invention includes joiner members so that the cross rails can be joined to the side rails at any one of a number of positions. By changing the position at which a cross rail is joined to the side rails, the depth of the floor base can be varied. Thus, the floor base of the present invention is adjustable both widthwise and lengthwise, whereas only the widths of the frames disclosed in the above-identified patents are adjustable, and this is another distinction between these patents and the present invention. Furthermore, because, among other reasons, the frames shown in the above-named patents have neither the integral spacing flanges nor the joiner members discussed above, these patents do not suggest the method of constructing combustible floor frames disclosed herein.

SUMMARY OF THE INVENTION

In view of the above, an object of this invention is to improve downflow furnace assemblies.

Another object of the present invention is to improve combustible floor bases of downflow furnace assemblies.

A further object of the invention is to provide a combustible floor base that can be used interchangeably with a variety of sizes of downflow furnace assemblies.

Another object of the present invention is to simplify the manufacture of combustible floor bases.

A fifth object of this invention is to provide a combustible floor base having integral spacing flanges.

These and other objectives are attained in a downflow furnace assembly having a combustible floor base including variable length cross rails for adjusting the width of the base, and including integral spacing flanges for maintaining the lower plenum of the assembly at a preset distance from a floor. An adjustable floor base, in addition to the inherent advantages of adjustability and interchangeability, substantially reduces the number of different types of floor bases which must be manufactured. This greatly simplifies the manufacture of floor bases. The integral flanges, which are formed by die pressing the same metal sheets that are pressed to form the rails of the base, eliminates the use of separate pieces to form the spacing flanges. This also significantly reduces the number of individual parts involved in the manufacturing process, further simplifying that process. In addition, integral flanges are, generally, less likely to break away from the rails than flanges which are welded to the rails. So, the use of integral flanges increases the durability and reliability of combustible floor bases.

In a preferred embodiment of the present invention, the floor base further includes joiner members which allow the cross rails to be secured to the side rails at a plurality of locations so that the depth of the base can also be varied. The joiner members not only allow the depth of the base to be varied but also permit the cross rails to be secured to the side rails by screws or the like, eliminating the necessity of spot welding ends of the rails together to form the base. Elimination of this step additionally reduces the complexity of the formation of combustible floor bases. Furthermore, since the base can be put together simply by screwing the rails together—a procedure which can be accomplished easily at the point of installation, the component rails can be shipped to that point in a broken down, very compact form.

Further benefits and advantages of the invention will become apparent from a consideration of the following description given with reference to the accompanying drawings which specify and show a preferred embodiment of the invention.

A BRIEF DESCRIPTION OF THE DRAWINGS

A DETAILED DESCRIPTION OF A PREFERRED EMBODIMENT

Figure 1:
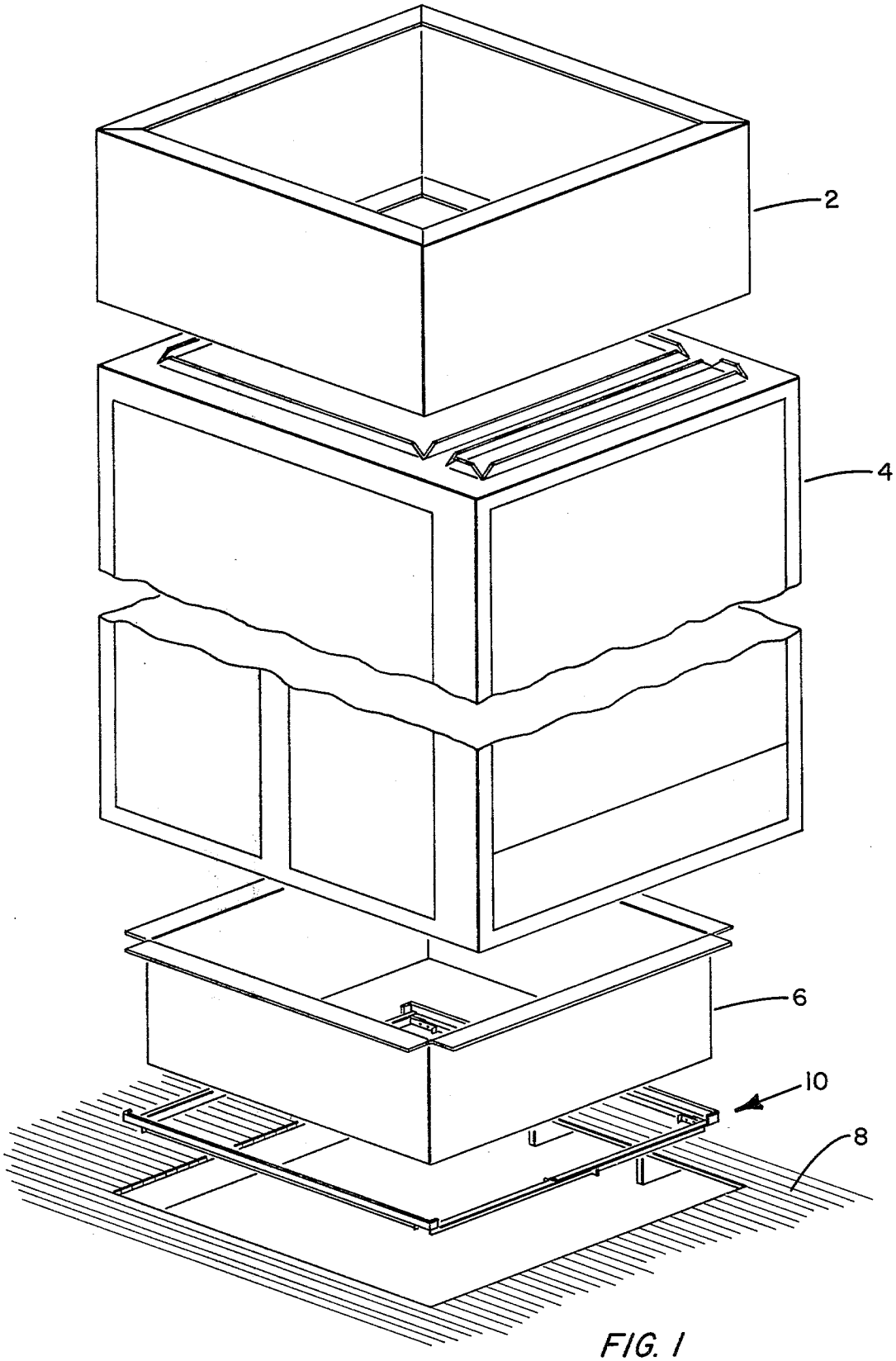
FIG. 1 is a perspective view of a downflow furnace assembly utilizing the teachings of the present invention.

Referring to the drawings, and particularly to FIG. 1, there is depicted the components of a downflow furnace assembly of the type that is commonly used to heat homes and other buildings. The assembly includes, generally, an upper or return air plenum 2 for receiving and collecting air directed to the plenum from the various rooms of the building via a plurality of return air ducts (not shown), a furnace 4 where heat is transferred from, as examples, electric resistant heaters or gas fueled burners to air coming to the furnace from the return air plenum, and blower means (not shown) to cause air to flow in a downward direction through the assembly. The assembly also includes a lower plenum 6 and a combustible floor base or frame 10. The lower plenum 6 receives air from the furnace 4 and directs the air to a plurality of room air ducts (not shown) which guide the heated air back to the individual rooms. These ducts are usually positioned underneath the floor 8 of the building. This requires, of course, positioning at least a part of the lower plenum 6 underneath the floor 8. The floor base 10 is provided for insulating the floor 8 from the lower plenum 6 and the furnace 4.

Figure 2:
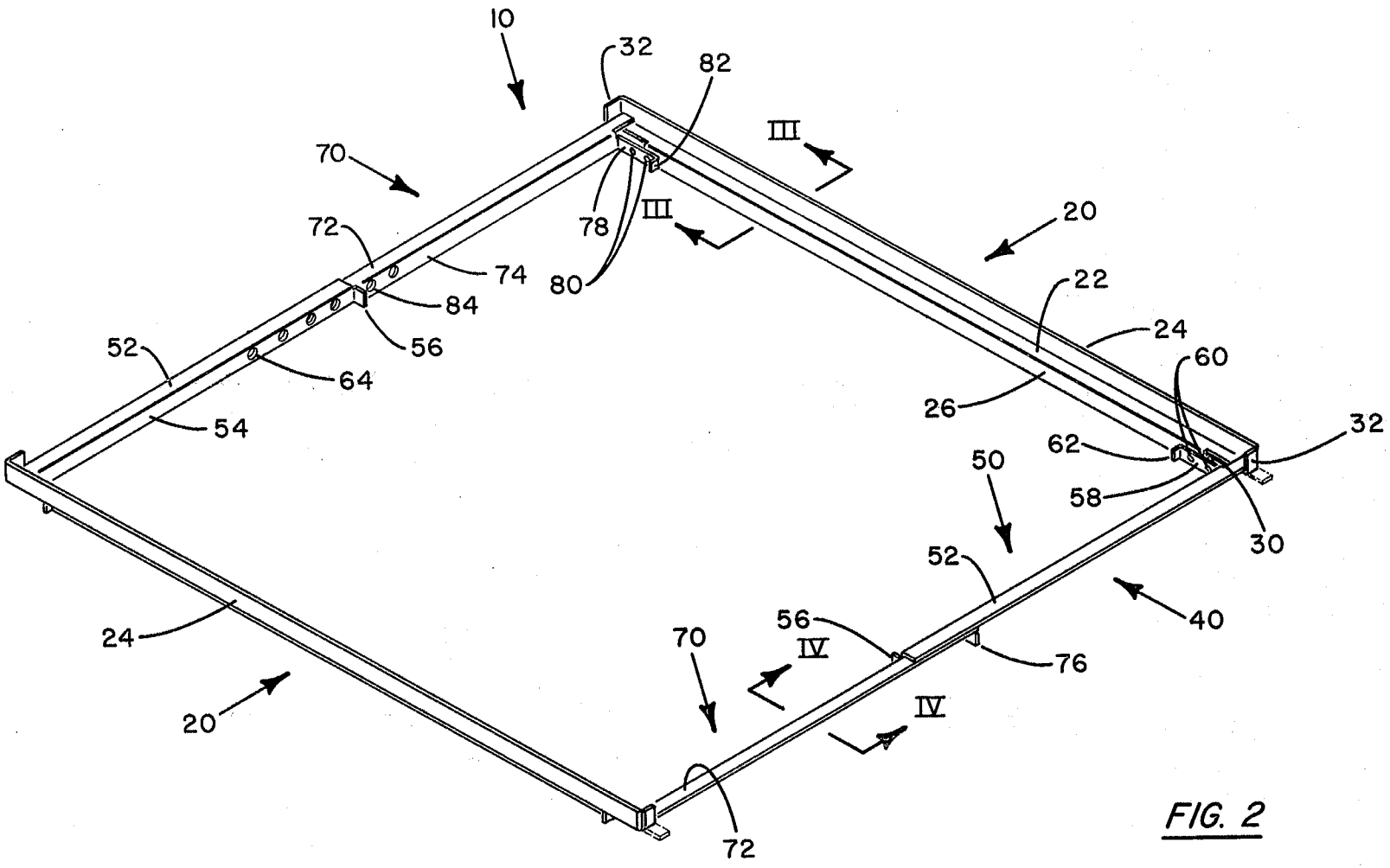
FIG. 2 is an enlarged perspective view of the floor base of the assembly shown in FIG. 1.

As shown best in FIG. 2, the floor base 10 is comprised of, generally, a pair of parallel side rails or depth supports 20 and a pair of adjustable, parallel cross rails or width supports 40. The individual side rails 20 are identical, so only one will be described in detail, but they are positioned in the frame 10 so that one side rail, relative to the other side rail, is rotated 180° about a vertical line running through the longitudinal center of the rail. Similarly, the cross rails 40 are identical, and only one will be described in detail, but they too are positioned in the frame 10 so that one cross rail, relative to the other cross rail, is rotated 180° about a vertical line running through the longitudinal center of the rail.

Figure 3:
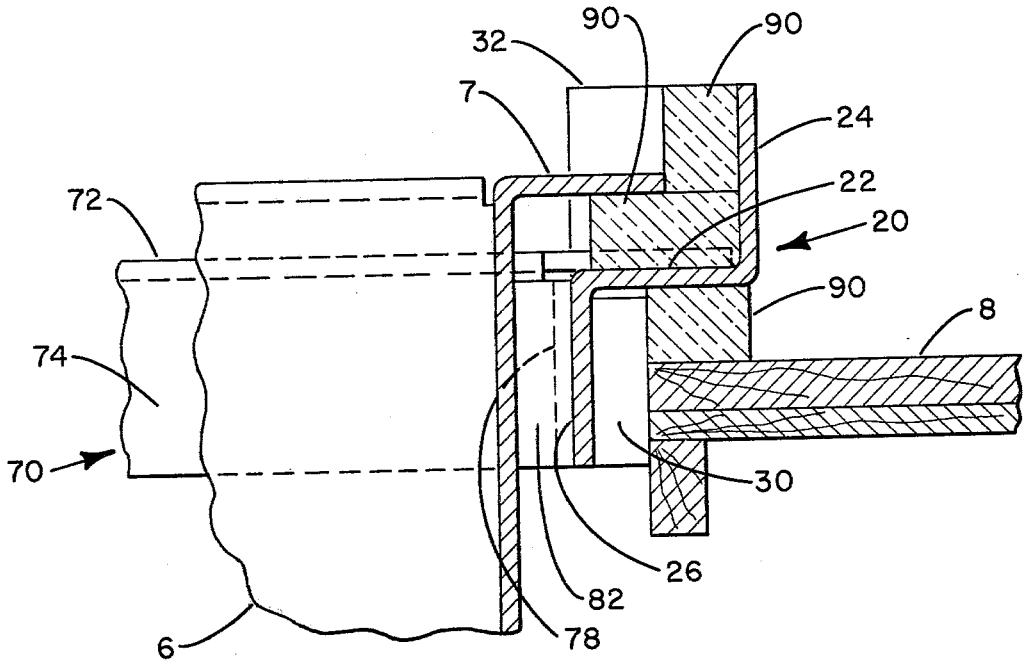
FIG. 3 is a sectional view of a side rail of the floor base shown in FIGS. 1 and 2 taken along line III—III of FIG. 2 with the floor base and the lower plenum in their installed position.
Figure 6:
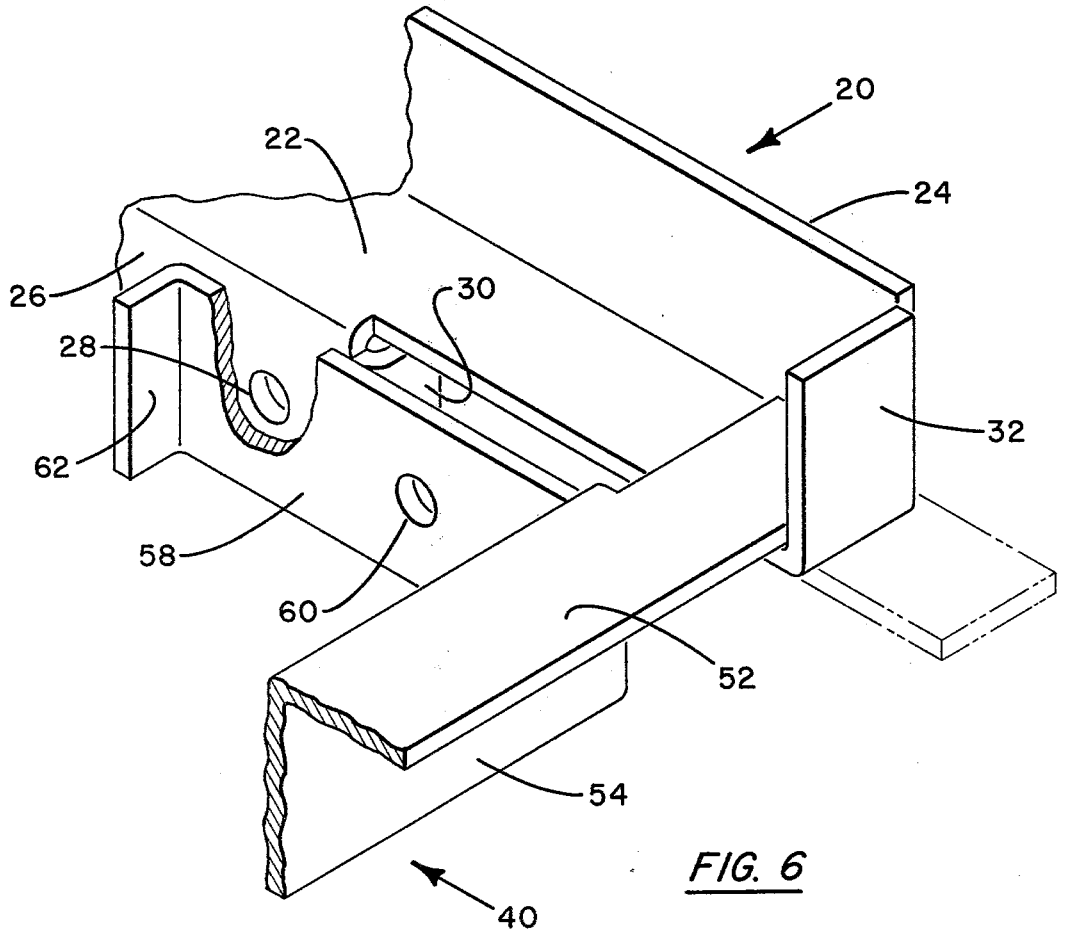
FIG. 6 is an enlarged perspective view of a corner of the floor base shown in FIGS. 1 and 2.

Referring to FIGS. 2, 3 and 6, a side rail 20 includes a longitudinal bottom segment 22. When the floor frame 10 is in the installed position, the bottom segment 22 is parallel to the surface of the floor 8. An upper side 24 extends above the bottom segment 22 along one longitudinal edge thereof, and a lower side 26 extends below the bottom segment along a second longitudinal edge thereof. Both the upper side 24 and the lower side 26 are generally perpendicular to the bottom segment 22. The upper side 24 extends upwards from the bottom segment 22 along the entire length of the bottom segment, and the lower side 26 extends downwards throughout a major portion of the length, but not the complete length, of the bottom segment 22. The surface of the lower side 26 defines a pair of holes 28, one hole being defined by the surface of each longitudinal end of the lower side. Side rail 20 also includes a pair of outside spacing members or flanges 30 and a pair of end sides 32. The end sides 32 extend upwards along the transverse edges of the bottom segment 22 and are generally perpendicular to both the bottom segment and the upper side 24. The outside spacing flanges 30 extend outwardly, toward the floor 8, from the transverse edges of the lower side 26 and are perpendicular thereto.

To form the side rail 20, a flat sheet of metal is cut and then stamped in a die press so that one side of the sheet is bent upwards to form the upper side 24, the other side of the sheet is bent downwards to form the lower side 26, and the holes 28 are formed in the lower side. After the upper side 24 and lower side 26 are formed, ends of the bottom segment 22 are bent to form the end sides 32, and the ends of the lower side are pressed to form the outside spacing flanges 30. Previously, spacing flanges were formed by spot welding separate, small pieces of metal to the rail. By forming the flanges 30 from the same metal sheet used to form the rail 20, the present invention eliminates the use of these separate, small pieces and the step of welding these pieces to the rail. The process of forming the side rail, hence, is greatly simplified. Furthermore, the integral flanges are, typically, less likely to break away from the rail 20 than are flanges which are spot welded to the rail. Thus, the integral flanges make the frame 10 sturdier and more durable.

Figure 4:
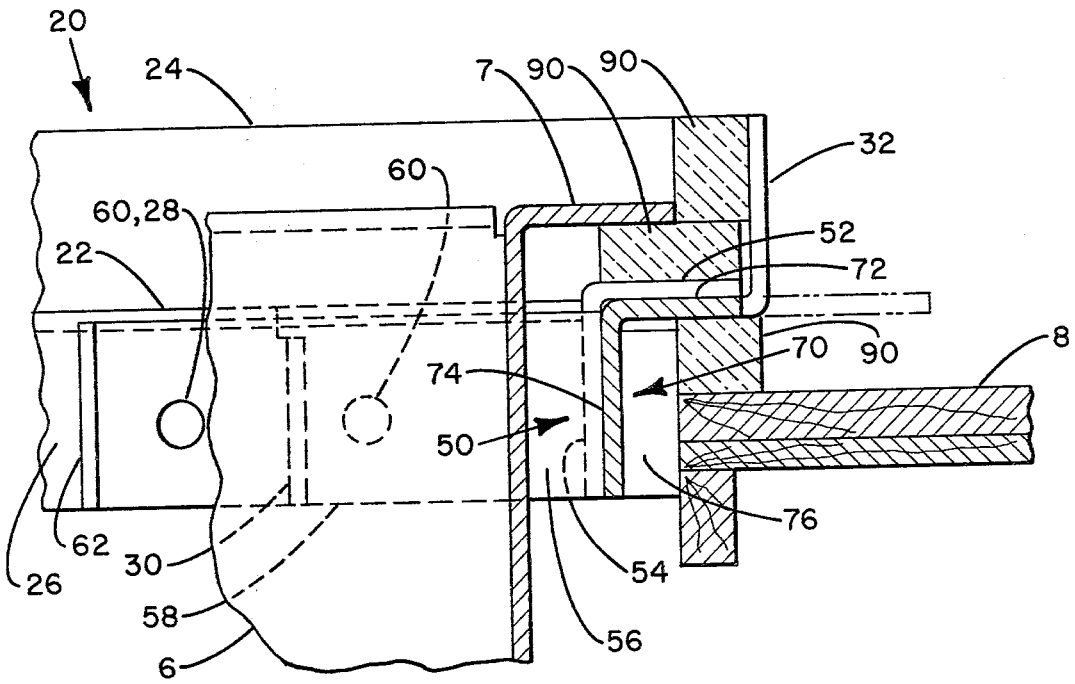
FIG. 4 is a sectional view of an adjustable cross rail of the floor base shown in FIGS. 1 and 2 taken along line IV—IV of FIG. 2 with the floor base and the lower plenum in their installed position.
Figure 5:
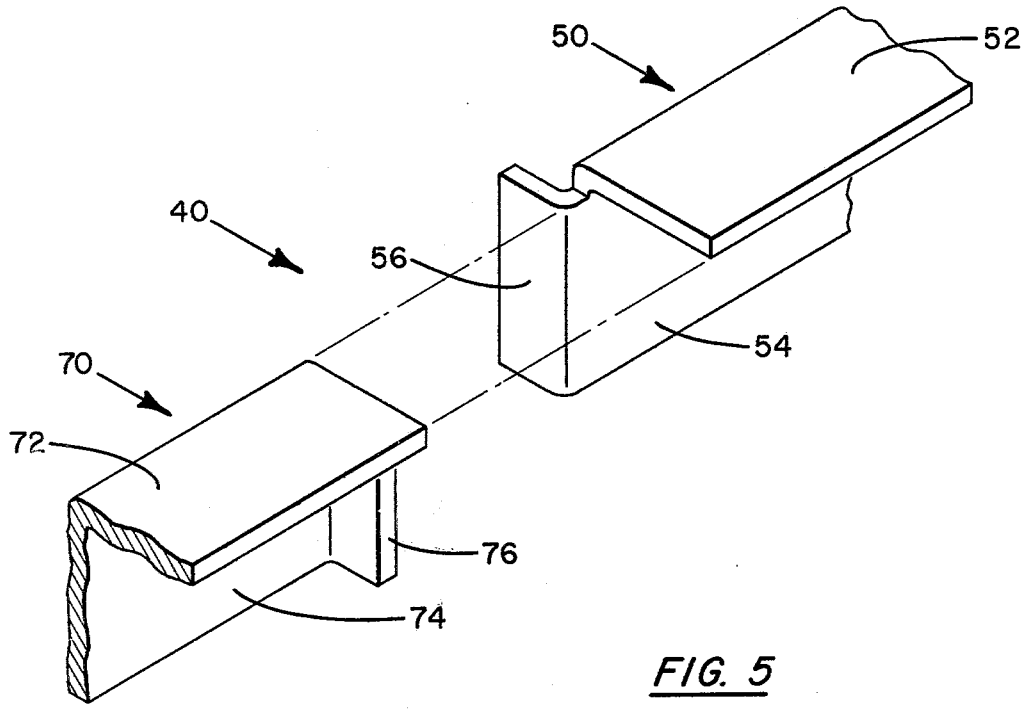
FIG. 5 is an enlarged perspective view of a portion of an adjustable cross rail of the floor base shown in FIGS. 1 and 2.

Referring now to FIGS. 2, 4 and 5, an adjustable cross rail 40 includes a first section 50 having a first bottom element 52 and a first side element 54. The first side element 54 extends along one longitudinal edge of the bottom element 52 and is perpendicular thereto. In addition, the first section 50 includes a plenum spacing member or flange 56, which extends along a transverse edge of the first side element 54 perpendicular thereto. In a preferred embodiment, a first joiner member 58 extends along the opposite transverse edge of the first side element 54 generally perpendicular thereto, and the surface of the first joiner member defines a pair of holes 60. The first section 50 also includes a first inside spacing member or flange 62 extending inwardly, toward the plenum 6, from a transverse edge of the first joiner member 58 perpendicular thereto. The cross rail 40 also includes a second section 70 having a second bottom element 72 and a second side element 74. The second side element 74 extends along one longitudinal edge of the second bottom element 72 and is perpendicular thereto. Furthermore, the second section 70 includes a floor spacing member or flange 76, which extends along a transverse edge of the second side element 74 perpendicular thereto. In a preferred embodiment, a second joiner member 78 extends along the opposite transverse edge of the second side element 74 generally perpendicular thereto, and the surface of the second joiner member defines a pair of holes 80. The second section 70 also includes a second inside spacing member or flange 82 extending inwardly, toward the plenum 6, from a transverse edge of the second joiner member 78 perpendicular thereto.

Sections 50 and 70 of the cross rail 40 are both generally L-shaped channels. The sections are shaped by stamping precut metal sheets so that the holes 60 and 80 are formed and one side of each sheet is bent perpendicular to the other side, forming the bottom elements 52 and 72 and side elements 54 and 74. After the bottom elements 52 and 72 and the side elements 54 and 74 are formed, the inside spacing flanges 56 and 76 are formed by bending first ends of the side elements. The joiner members 58 and 78 are fashioned by bending the other ends of the side elements 54 and 74, and the spacing flanges 62 and 82 are shaped by bending ends of the joiner member. To form the rail 40, the two sections 50 and 70 are interfitted so that the sections are in slidable communication with each other. That is, the sections 50 and 70 are positioned so that the first bottom element 52 is supported by and can ride over the second bottom element 72, while at the same time the first side element 54 can move past the second side element 74. By sliding the first section 50 with respect to the second section 70, the cross rail 40 can be adjusted so that it may be used interchangeably in any one of a number of downflow furnace assemblies. This interchangeability simplifies the manufacture of combustible floor frames by reducing the number of different types of frames that must be produced. Also, this interchangeability decreases the likelihood that a suitable floor frame will not be available at the point of installation of a downflow furnace assembly.

The surface of the first side element 54 defines a plurality of holes 64, and the surface of the second side element 74 defines a plurality of holes 84. The holes 64 and 84 may be formed at the same time and in the same manner that the holes 60 and 80 are formed. By sliding the first and second sections 50 and 70 of a cross rail 40 with respect to each other, holes 64 of the first side element 54 can be aligned with holes 84 of the second side element 74. The cross rails 40 are identical so that when a pair of holes of one cross rail 40 are aligned and the corresponding pair of holes of the second cross rail 40 are aligned, then the two cross rails are the same length. This allows a simple and reliable adjustment of the variable length rails 40 to identical lengths. The adjustable rails 40 can be varied to an infinite number of sizes, but the holes 64 and 84 are located so that the rails can quickly and easily be set at lengths which correspond to widths of common downflow furnace assemblies.

When the sections 50 and 70 are interfitted to form the cross rail 40, the plenum spacing flange 56 extends inwardly from the cross rail 40 to maintain a predetermined distance between the cross rail and the lower plenum 6, and the floor spacing flange 76 extends outwardly from the cross rail 40 to maintain a predetermined distance between the cross rail and the edge of the floor 8. Thus, spacing flanges 56 and 76 cooperate with the lower plenum 6, the edge of the floor 8, and the cross rail 40 to maintain the lower plenum at a preset distance from the portion of the floor that is separated from the plenum by the cross rail 40. This helps to insulate the floor 8 from the plenum 6. Heretofore, similar to the outside spacing flanges 30, the spacing flanges 56 and 76 were made by spot welding individual pieces of metal to the cross rail 40. By constructing the flanges 56 and 76 from the same metal sheets used to form the sections 50 and 70 of the cross rail 40, the present invention further reduces the number of separate pieces involved in the formation of combustible floor bases, simplifying that formation. At the same time, the integral spacing flanges increase the strength and reliability of the floor base.

To form the base 10 from the component rails 20 and 40, one end of the first bottom element 52 of a first cross rail 40 is placed on the bottom segment 22 of a first side rail 20, and one end of the second bottom element 72 of the first cross rail 40 is placed on the bottom segment 22 of the second side rail 20. Then, one end of the first bottom element 52 of the second cross rail 40 is placed on the bottom segment 22 of the first side rail 20, and one end of the second bottom element 72 of the second cross rail 40 is placed on the bottom segment 22 of the second side rail 20. After being so placed, the cross rails 40 can slide along the lengths of the bottom segments 22 of the side rails 20, varying the depth of the floor base 10. The joiner members 58 and 78, in the manner described below, allow each cross rail 40 to be attached to the side rails 20 at any one of a number of locations. Since the lengths of the adjustable rails 40 can also be varied, the width of the floor base 10 can likewise also be adjusted. Thus, the floor base 10 can be used interchangeably with downflow furnace assemblies of different widths and different depths. One floor base 10, constructed according to the present invention, can accomodate any one of a number of downflow furnace assemblies having a wide range of furnace and evaporator coil casing sizes.

FIG. 6 shows a corner of the floor base 10 in greater detail. As can be seen, when the first bottom element 52 of a first cross rail 40 is placed on the bottom segment 22 of a first side rail 20, the first joiner member 58 of the first cross rail 40 is parallel to and adjacent to the lower side 26 of the first side rail 20. Similarly, when the second bottom element 72 of the first cross rail 40 is placed on the bottom segment 22 of the second side rail 20, the second joiner member 78 of the first cross rail 40 is parallel to and adjacent to the lower side 26 of the second side rail 20. The first rail 40 can slide along the side rails 20 until one of the holes 60 defined by the surface of the first joiner member 58 is aligned with a hole 28 defined by the surface of one longitudinal end of the lower side 26 of the first side rail 20. The holes 80 of the second joiner member 78 are aligned with the holes 60 of the first joiner member 58. Also, the hole 28 in each longitudinal end of the lower side 26 of the first side rail 20 is aligned with the hole in the corresponding longitudinal end of the lower side of the second side rail. Thus, when a hole 60 in a first joiner member 58 of the first cross rail 40 is aligned with the hole 28 in a longitudinal end of a first side rail 20, a hole 80 in the second joiner member 78 of the first cross rail 40 is likewise aligned with the hole 28 in the corresponding longitudinal end of the second side rail 20.

Since both cross rails 40 are identical and both side rails 20 are identical, holes 60 and 80 of the joiner members 58 and 78 of the second cross rail 40 can, in a similar manner, also be aligned with holes 28 in the lower sides 26 of the side rails 20. When holes 60, 80 and 28 are so aligned, the cross rails 40 can be secured to the side rails 20 by driving a screw or the like through the aligned holes. In this way, no spot welding is needed to join the rails together. First, this simplifies the formation of the base 10. Second, since only a screwdriver and screws are needed to join the rails 20 and 40, the base 10 can easily be assembled at the point of installation. This permits the floor base 10 to be shipped to that point in a broken down, very compact shape, and this substantially facilitates shipment of the base.

Although in a preferred embodiment there are a plurality of holes 60 and 80 in each joiner member 58 and 78 and one hole 28 in each longitudinal end of the lower sides 26, other equally satisfactory arrangements will be apparent to one skilled in the art. For example, there could be just one hole in each joiner member 60 and 80 and a plurality of holes in each longitudinal end of the lower sides 26. Furthermore, in a preferred embodiment both cross rails 40 can easily be secured to the side rails at a plurality of positions. However, the depth of the floor base 10 can be satisfactorily adjusted so long as either one of the cross rails 40 can be moved to vary the depth of the base. It is preferred, though, that both cross rails 40 be securable to the side rails 20 at a plurality of positions as this increases the adaptability of the floor base 10.

When the base 10 is formed, the first and second joiner members 58 and 78 are adjacent to the lower sides 26 of the side rails 20, and the first and second inside spacing flanges 62 and 82 extend inwardly from the joiner members and are generally perpendicular to both the joiner members and the side rails. The inside spacing flanges 62 and 82 act to maintain the lower plenum 6 at a predetermined distance from the side rail 20. Thus, the inside spacing flanges 62 and 82 cooperate with the outside spacing flanges 30, described above, to keep the lower plenum 6 at a preset distance from the portions of the combustible floor 8 that are separated from the plenum by the side rails 20. By using integral flanges, as discussed above, the combustible floor base is strengthened and the manufacture of floor bases is simplified.

In FIGS. 3 and 4, the side rail 20, the adjustable rail 40, and the lower plenum 6 are shown in the installed position. Various pieces of insulating material 90 are used to thermally insulate the rails 20 and 40 and the plenum 6 from the floor 8. After the floor base 10, the insulating material 90, and the lower plenum 6 are installed, the furnace 4 is installed by placing the lower edges of the furnace directly upon the upper flanges 7 of the plenum 6. The insulating material 90 is generally easily deformable and can be shaped and fitted at the point of installation so that the downflow furnace assembly is completely insulated from the floor 8. Heat is, thus, prevented from transferring to the floor 8 from the assembly. This increases the efficiency of the downflow furnace assembly by eliminating heat loss, and this prevents the floor 8 from overheating.

In some applications, the depth of the furnace 4 is greater than the length of the side rails 20. In such a case, end sides 32 of the rails 20 can be bent to the position shown in broken lines in FIGS. 2, 4 and 6 so that the end sides 32 do not prevent the bottom edges of the furnace 4 from resting directly on the upper flanges 7 of the plenum 6.

While it is apparent that the invention herein disclosed is well calculated to fulfill the objects above stated, it will be appreciated that numerous modifications and embodiments may be devised by those skilled in the art and it is intended that the appended claims cover all such modifications and embodiments as fall within the true spirit and scope of the present invention.

What is claimed is:

1. In a downflow furnace assembly of the type having a plenum for extending through a floor, a floor base for thermally insulating the plenum from the floor, the floor base comprising:

a pair of side rails, each side rail having (a) a generally horizontal support section for supporting the plenum, (b) a lower flange extending below the support section along a first longitudinal edge thereof generally perpendicular thereto, and (c) an integral first side spacing member extending from a longitudinal end of the lower flange generally perpendicular to both the lower flange and the support section;

a pair of cross rails extending between the side rails, each cross rail having a pair of track sections in slidable communication with each other for varying the length of the cross rail and the width of the floor base, each track section including (a) a generally horizontal track surface for further supporting the plenum, (b) a track flange extending below the track surface along a longitudinal edge thereof, and (c) an integral cross spacing member extending from a first longitudinal end of the track flange generally perpendicular to both the track flange and the track surface; and wherein:

each track surface of a first cross rail is in slidable communication with a support surface of a side rail for varying the depth of the floor base;

the track sections of the first cross rail each further includes (d) a connecting arm extending from a second longitudinal end of the track flange of the track section and extending adjacent and generally parallel to a lower flange of a side rail for connecting the first cross rail to the side rail, and (e) an integral second side spacing member extending from a longitudinal end of the connecting arm generally perpendicular thereto;

a first track section of each cross rail defines a plurality of holes, and the second track section of each cross rail defines at least one hole for cooperating with the holes defined by the first track section for adjusting the cross rail to various preset lengths;

a selected one of the first and second side spacing members extends inward for maintaining a predetermined distance between the side rail and the plenum, and the other one of the first and second side spacing members extends outward for maintaining a predetermined distance between the side rail and the floor;

a selected one of the cross spacing members extends inward for maintaining a predetermined distance between the cross rail and the plenum, and the other one of the cross spacing members extends outward for maintaining a predetermined distance between the cross rail and the floor; and a selected one of a first connecting arm and a first lower flange defines a plurality of holes, and the other one of the first connecting arm and first lower flange defines at least one hole, a selected one of the second connecting arm and the second lower flange defines a plurality of holes, and the other one of the second connecting arm and second lower flange defines at least one hole, and the holes defined by the connecting arms and lower flanges cooperate for adjusting the floor base to various preset depths.

2. The floor base as defined by claim 1 wherein each lower flange has a length shorter than the length of the support member from which the lower flange extends to facilitate adjusting the depth of the floor base.

3. The floor base as defined by claim 2 wherein each side rail further includes:

(d) an upper flange extending above the support section generally perpendicular thereto along a second longitudinal edge thereof to facilitate placing an insulating material on the support section; and (e) an end side extending above the support section generally perpendicular thereto along a transverse edge thereof to facilitate positioning a cross rail relative to the side rail.

4. A method of manufacturing components of a floor base comprising the steps of:

bending first and second longitudinally extending metal sheets to form a pair of side rails, each side rail having a support surface and a lower flange generally perpendicular thereto;

bending a longitudinal end of each lower flange to form a side spacing member integral therewith and generally perpendicular thereto;

bending a third longitudinally extending metal sheet to form an inside channel member having generally perpendicular top and side surfaces;

bending a fourth longitudinally extending metal sheet to form an outside channel member having generally perpendicular top and side surfaces adapted for slidable communication with the inside channel member; and bending a first longitudinal end of the side surface of a first channel member to form a cross spacing member integral therewith and generally perpendicular thereto.

5. The method of claim 4 further including the steps of bending the second longitudinal end of the side surface of the first channel member to form a connecting arm integral therewith and generally perpendicular thereto for connecting the first channel member with the lower flange of a first side rail; and bending a first longitudinal end of the side surface of the second channel member to form a connecting arm integral therewith and generally perpendicular thereto for connecting the second channel member with the lower flange of the second side rail.

6. The method of claim 5 wherein:

the step of bending a longitudinal end of each lower flange includes the step of outwardly bending a longitudinal end of each lower flange to form an outside side spacing member; and the step of bending a first longitudinal end of the side surface of a first channel member includes the step of inwardly bending a first longitudinal end of the side surface of the inside channel member to form an outside cross spacing member; and further including the steps of:

outwardly bending the second longitudinal end of the side surface of the outside channel member to form an inside cross spacing member integral therewith and generally perpendicular thereto; and outwardly bending a longitudinal end of each connecting arm to form inside side spacing members integral therewith and generally perpendicular thereto.

* * * * *